US005472364A

United States Patent [19]

Castleman

[11] Patent Number: 5,472,364

[45] Date of Patent: Dec. 5, 1995

[54] TOY REVERSIBLE BETWEEN PUPPET AND BOOK FORMS

[76] Inventor: Virginia Castleman, 7166 Enterprise Dr., Las Vegas, Nev. 89117

[21] Appl. No.: 358,840

[22] Filed: Dec. 19, 1994

[51] Int. Cl.[6] ..... A63H 33/00; A63H 33/38; B42D 3/00; B42D 3/18

[52] U.S. Cl. ..... 446/71; 446/147; 446/327; 281/29; 281/51

[58] Field of Search ..... 281/29, 51; 446/71, 446/147, 327, 328, 329, 487, 491, 369

[56] References Cited

U.S. PATENT DOCUMENTS

| | | | |
|---|---|---|---|
| D. 217,654 | 5/1970 | Ryland . | |
| 3,918,180 | 11/1975 | Chamberlin . | |
| 4,280,241 | 7/1981 | Pfaff | 281/51 X |
| 4,372,077 | 2/1983 | Balbuena . | |
| 4,508,515 | 4/1985 | Skolnick . | |
| 4,555,236 | 11/1985 | Peyton . | |
| 4,577,889 | 3/1986 | Schulz | 281/51 X |
| 4,608,024 | 8/1986 | Skolnick . | |
| 4,832,648 | 5/1989 | Theobald et al. . | |
| 4,842,565 | 6/1989 | Von Philp, Sr. | 446/369 X |
| 4,853,994 | 8/1989 | Ekstein . | |
| 4,874,340 | 10/1989 | Smallwood | 446/369 X |
| 5,059,149 | 10/1991 | Stone | 446/71 X |
| 5,308,275 | 5/1994 | Kornbleuth | 446/329 X |

FOREIGN PATENT DOCUMENTS

| | | | |
|---|---|---|---|
| 8301392 | 4/1983 | WIPO | 446/327 |

OTHER PUBLICATIONS

Photographs of bunny puppet, copyright 1991 by Judith Blau (Exhibits 1–3).

*Primary Examiner*—Robert A. Hafer
*Assistant Examiner*—D. Neal Muir
*Attorney, Agent, or Firm*—Quirk & Tratos

[57] ABSTRACT

A puppet toy which can be transformed from a book to a puppet and vice versa is disclosed. The puppet toy comprises a cover having a pocket therein. A number of pages are connected to the cover, such that in one form the puppet toy is a book. A number of puppet features are located on the inside surface of the pocket of the cover. The puppet toy is turned inside-out to transform the book into a puppet.

12 Claims, 1 Drawing Sheet

TOY REVERSIBLE BETWEEN PUPPET AND BOOK FORMS

BACKGROUND OF THE INVENTION

1. Field of the Invention

This invention is in the field of education and entertainment and, more particularly, is a toy puppet that is convertible into a book and vice versa.

2. Description of the Prior Art

A significant problem in today's modern society is developing a child's reading and thinking skills. Television and video games, which consume a large portion of a child's free time, do not develop these skills.

A significant portion of a child's intellectual capacity, and a child's ultimate desire to engaging in intellectual activities, is determined within the first years of life. It is important, therefore, to encourage a child to read and develop intellectual skills at a very early age.

Keeping a child interested in reading, especially during the early years, is often difficult. New and innovative means for peaking a child's interest in reading, such as exciting book material, are needed.

Further, children need to "play" in order to develop both their motor skills, and their intellectual capacity through their sense of imagination. This "play" is useful in developing a child's oral skills as well, as the child normally talks and makes other sounds while acting out various scenarios.

Puppets have proven useful in prompting the desired "play" activities. Puppet theater is thought to have its origins in the orient about 4000 years ago. It migrated from the orient and flourished in the early Mediterranean civilizations. Wandering showmen of the Middle Ages used puppet theater as an entertainment medium while churches of the Middle Ages used it to portray the scriptures. Since the Renaissance, puppet theater has been an established form of entertainment in Europe from where, in the nineteenth century, emigrants brought it to North America.

A critical difference between human theater and puppet theater is that an actor in human theater represents a character, whereas a puppet in puppet theater is the character. In other words, the puppet has the potential of being something that is the essence of a character and nothing else.

Because the puppet's potential, it has attracted the attention of artists such as Edward Gordon Craig, Jean-Baptiste Molière, Jean Cocteau, Paul Klee and George Bernard Shaw. Additionally, it has aroused the curiosity and sparked the imagination of generations of children.

The puppet may, for example, consist of a mitten-like body connected to a feature such as a head. A person's hand fits into the body. Movement of the head or other features of the puppet is accomplished by the person manipulating her fingers within the body.

When the puppet is combined with a book, text of the book may be used to define the puppet's character. The combination of a puppet and a book is exemplified by U. S. Pat. No. 3,918,180 where three-dimensional puppets extend through openings in the pages. However, because the book and the puppet are visibly connected, the puppet becomes a demonstrable extension of the book; it loses the potential of being a completely independent entity, i.e. it can not be the essence of a character.

Heretofore, a puppet and the book have not been combined in a structure that maximizes the potential of both a book and a puppet.

SUMMARY OF THE INVENTION

An object of the present invention is to combine a book and a puppet in a structure that maintains the book's potential of acting independent from the puppet, and maintains the puppet's potential of being the essence of a character, being a completely independent entity from the book. Another object of the present invention is to combine a puppet and a book in a structure where the book and puppet are not demonstrable extensions of one another.

According to the present invention, a puppet toy converts to book having a cloth cover with a pocket therein. The pocket is turned inside-out to convert the book to the puppet and vice versa. Features of the puppet are connected to a body portion of the puppet formed from the inside surface of the pocket when it is turned inside-out.

When the book of the present invention is converted to a puppet, there is no visible connection to the book. When the puppet is converted to the book, text included on pages thereof may be used to define the character of the puppet.

Other features, and advantages of the invention will be apparent from the following description of the preferred embodiment as illustrated in the accompanying drawing.

DESCRIPTION OF THE PREFERRED EMBODIMENT

Figure 1:
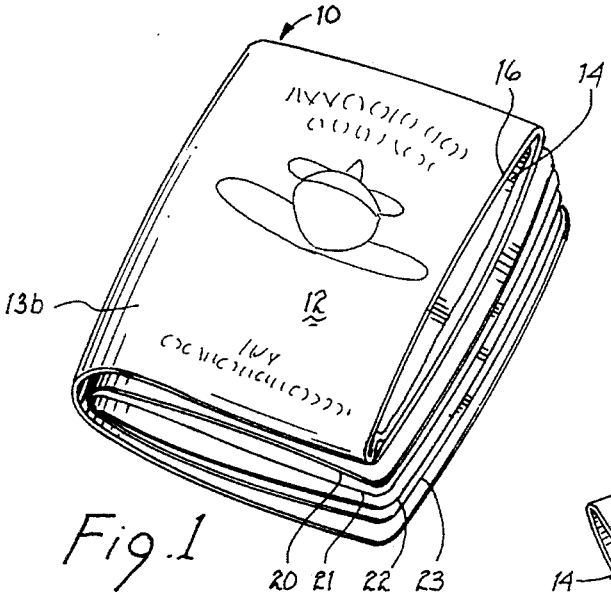
FIG. 1 is a perspective view of a puppet toy in closed book form in accordance with the preferred embodiment.
Figure 2:
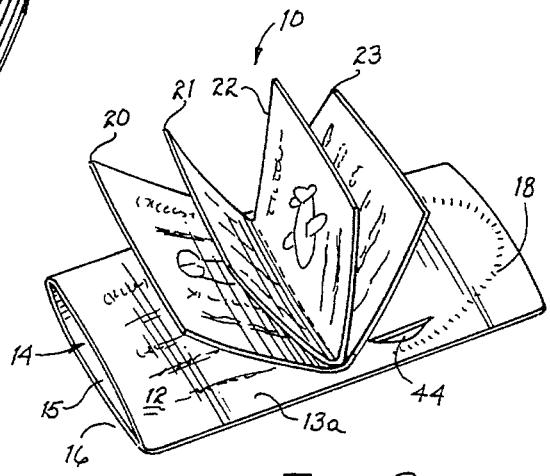
FIG. 2 is a perspective view of the toy of FIG. 1 opened.
Figure 4:
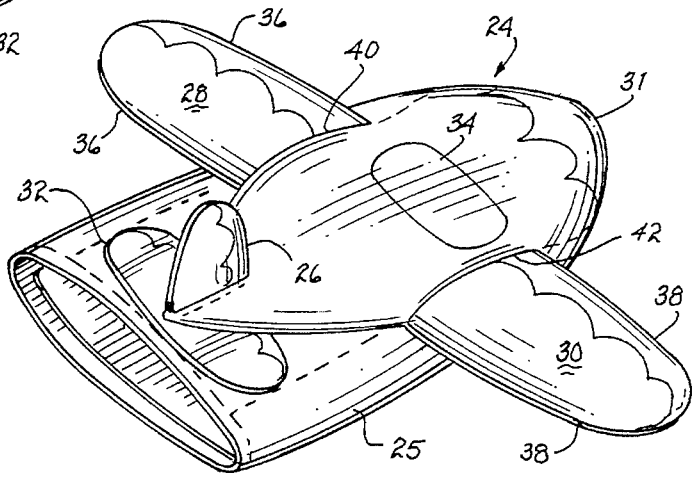
FIG. 4 is perspective view of the toy in puppet form when the cover of the book of FIG. 1 is turned inside out.

FIGS. 1 and 4 shown the present invention, which is transformable between a book and a puppet, a vice versa. More particularly, and as shown in FIGS. 1 and 2, a puppet toy 10 is shown in the form of a book having a cloth cover 12 with a pocket 14 therein that has an open end 16. The cover 12 has an outside front surface 13*a* and an outside rear surface 13*b*. The cover 12 also has an interior surface 15 located in said pocket 14.

Stitching 18 through cover 12 (FIG. 2) forms a deep end of pocket 14. As explained hereinafter, stitching 18 is along an arcuate path that determines the shape of the nose of an airplane puppet.

In this embodiment, cloth pages 20–23 are sewn onto the outside front surface 13*a* of the cover 12. Additionally, pages 20–23 and cover 12 carry text and images that are printed thereon in any suitable manner. In an alternative embodiment, the text and images are embroidered onto pages 20–23 and cover 12.

Figure 3:
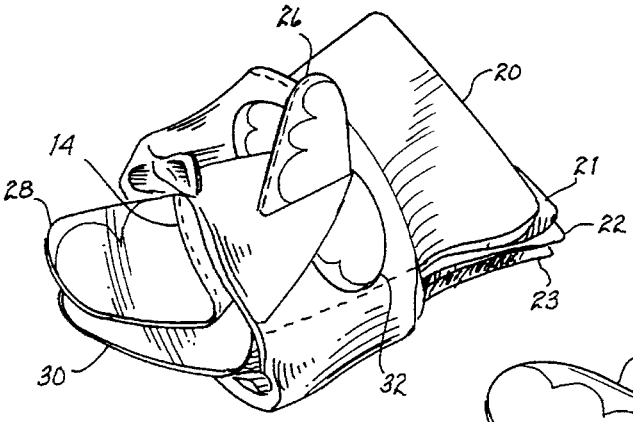
FIG. 3 is a perspective view of the cover of the toy in book form partially turned inside out.

As shown in FIGS. 3 and 4, as pocket 14 is turned inside out, the inside surface 15 of the pocket becomes the outside surface of the puppet, and includes features of an airplane puppet 24. At the same time, the pages 20–23 of the book become hidden within the puppet 24. Puppet 24 has a mitten-like body 25 that is the fuselage of puppet 24. Because of stitching 18, the fuselage has an arcuate nose 31. In an alternative embodiment, stitching is used to form other features of a puppet.

Features such as a rudder 26 and wings 28, 30 are made from cloth that is sewn onto body 25. Features such as a stabilizer 32 and a cockpit 34 are printed images that are carried on body 25. Additionally, rudder 26, wings 28, 30, stabilizer 32 and body 25 carry printed designs.

Each of wings 28, 30 is made from top and bottom layers of cloth that are sewn together along wing edges 36, 38, respectively. Accordingly, the interior of wings 28, 30 are defined as being between their respective top and bottom layers.

It should be understood that the layers are not sewn together along seams 40, 42 where wings 36, 38, respectively, are connected to body 25. As explained hereinafter, because the layers are not sewn together along seams 40, 42, wings 28, 30 may be manipulated from the interior of puppet 24.

A slit 44 (FIG. 1) through cover 12 forms a passageway that extends from the exterior of cover 12 to the interior of wing 30. A similar slit (not shown) through cover 12 forms a passageway that extends from the exterior of cover 12 to the interior of wing 28. Accordingly, when a person places her hand within body 25, a finger may be inserted through slit 44 to manipulate wing 28. Wing 30 may be similarly manipulated.

A nearly limitless variety of puppet designs are available in connection with the present invention. For example, the puppet may take the form of a shark, alligator, hippopotamus, doll, car or other figure. Depending on the particular arrangement of stitching, folds or other features, various portions of the puppet may be manipulatable. For example, by locating a fold in the deep end of the pocket, the puppet may include a manipulatable mouth.

A variety of printing or additional stitching and materials can be used to accentuate the features of the puppet and make it life-like. For example, felt or cloth teeth may be located in a mouth portion of a shark puppet, or a long flexible cloth member attached to the nose of the puppet simulates an elephant's trunk.

Cloth such as cotton-weave material, or nylon, rayon, or wool including material is suitable for construction of the book 10. Preferably, the material is durable and thin and smooth enough that a user can easily pull the book inside-out. While cloth is preferred, the book 10 could be constructed of an opaque plastic, vinyl or similar material.

At least one discrete page 20, but preferably two to six pages 20–23 or more may be located on the book. Increased numbers of pages, however, can make more difficult the book to puppet (and vice versa) transformation.

Printing, such as letters, pictures or other indicia may be located on one or both sides of each page. Further, it is desired that the outside rear surface **13*b* of the cover 12 include title or other book labelling. In a preferred embodiment, the printing on the pages 20–23 relates to the puppet. For example, text relating to how an airplane works and its features may be located on the pages of the book when the puppet of the toy 10** has the form of an airplane.

While the features of the puppet and the pages of the book are preferably formed and attached with stitching, other attachment means may be used. For example, staples may be used to attach the pages to the cover, or obstruct portions of the puppet for forming puppet features.

While the invention has been particularly shown and described with reference to a preferred embodiment thereof, it should be understood by those skilled in the art that changes in form and detail may be made therein without departing from the spirit and scope of the invention.

I claim:

1. A puppet toy that is convertible from a book to a puppet and vice versa, comprising:

a cover member formed from a tubular cloth sleeve having a pocket therein with an opening at one end; and at least one book page connected to an outside surface of said cover, on one side of said cover adjacent a midpoint of said cover, said cover larger across than said at least one page so that said cover may be inverted to enclose said at least one page and at least one puppet feature located on an inside surface of the cover in said pocket, whereby in one position said puppet toy is a book having one or more pages and the cover, and whereby said toy forms a puppet when pulled inside-out, said feature(s) located on said inside surface of the pocket being exposed.

2. The toy of claim 1 wherein said pages are made from cloth and sewn to said cover.

3. The toy of claim 1 wherein said feature is made from two layers of cloth that are sewn onto a body where an interior of a feature is defined as being between said layers, a slit in said cover forming a passageway to the interior of said feature.

4. The toy of claim 1 additionally comprising stitching through said cover that is used to form a feature of said puppet.

5. The toy of claim 1 additionally comprising an image that is carried on said inside surface of said cover to form a feature of said puppet.

6. The toy of claim 5 wherein said image is printed on said inside surface of said cover.

7. In the method of making a puppet convertible to a book, comprising the steps of providing a puppet of the type that has a mitten-like body, of cloth having an outer surface with puppet features attached to said outer surface and having an inner side:

turning said puppet inside out, whereby the inside of said body becomes a cover of said book; and connecting pages of said book to said cover with said pages being smaller than said body to allow said pages to be contained inside said mitten-like body when manipulated to expose the puppet.

8. In the method of claim 7 wherein said step of connecting includes sewing cloth pages of said book to said cover.

9. In the method of claim 7, the additional step of stitching through said cover to form a feature of said puppet.

10. In the method of claim 7, the additional steps of:

forming a feature of said puppet from two layers of cloth that are sewn together, where the interior of said feature is defined as being between said layers;

sewing said feature onto said body; and providing a passageway through said cover to the interior of said feature.

11. In the method of claim 7, the additional step of carrying an image on said body.

12. In the method of claim 11 wherein said step of carrying includes printing said image onto said body.

* * * * *